US008708742B2

(12) United States Patent
Chan et al.

(10) Patent No.: US 8,708,742 B2
(45) Date of Patent: Apr. 29, 2014

(54) CARD CONNECTOR

(75) Inventors: Ching-Jung Chan, New Taipei (TW); Ta-Chih Yu, New Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 110 days.

(21) Appl. No.: 13/559,605

(22) Filed: Jul. 27, 2012

(65) Prior Publication Data

US 2014/0030923 A1 Jan. 30, 2014

(51) Int. Cl.
*H01R 13/648* (2006.01)

(52) U.S. Cl.
USPC ..... 439/607.22

(58) Field of Classification Search
USPC ..... 439/607.22, 607.31–607.35, 630, 159
See application file for complete search history.

(56) References Cited

U.S. PATENT DOCUMENTS

| | | | | |
|---|---|---|---|---|
| 5,413,490 | A * | 5/1995 | Tan et al. | 439/76.1 |
| 5,490,043 | A * | 2/1996 | Tan et al. | 361/818 |
| 5,509,824 | A * | 4/1996 | Rodrigues et al. | 439/607.08 |
| 5,839,907 | A * | 11/1998 | Kuo | 439/76.1 |
| 6,146,193 | A * | 11/2000 | Yu | 439/541.5 |
| 6,247,968 | B1 * | 6/2001 | Wu | 439/607.22 |
| 6,394,843 | B1 * | 5/2002 | Chang et al. | 439/607.22 |
| 6,478,630 | B1 * | 11/2002 | Hsu | 439/680 |
| 6,767,232 | B1 * | 7/2004 | Tien | 439/159 |
| 6,984,151 | B2 * | 1/2006 | Wu | 439/607.56 |
| 6,994,573 | B2 * | 2/2006 | Tanaka et al. | 439/159 |
| 7,192,310 | B1 * | 3/2007 | Chao et al. | 439/607.45 |
| 7,341,489 | B2 * | 3/2008 | Kuo | 439/630 |
| 7,367,827 | B2 * | 5/2008 | Chen | 439/159 |
| 7,467,976 | B2 * | 12/2008 | Ting | 439/607.01 |
| 7,559,804 | B2 * | 7/2009 | Cheng | 439/630 |
| 7,563,132 | B2 * | 7/2009 | Ting | 439/541.5 |
| 7,682,194 | B2 * | 3/2010 | Lin et al. | 439/607.31 |
| 7,753,723 | B2 * | 7/2010 | Ting | 439/541.5 |
| 7,806,701 | B2 * | 10/2010 | Tochi et al. | 439/76.1 |
| 8,206,161 | B1 * | 6/2012 | Lan et al. | 439/76.1 |
| 8,282,404 | B1 * | 10/2012 | Little et al. | 439/95 |
| 8,529,298 | B2 * | 9/2013 | Zhu et al. | 439/630 |
| 8,535,099 | B1 * | 9/2013 | Lin | 439/607.4 |
| 2007/0134959 | A1 * | 6/2007 | Hsiao | 439/159 |

* cited by examiner

*Primary Examiner* — Amy Cohen Johnson
*Assistant Examiner* — Vladimir Imas

(57) ABSTRACT

A card connector includes an insulating housing having a pair of side walls of which one protrudes outward to form two stop blocks spaced along a front-to-rear direction, a plurality of electrical terminals disposed in the insulating housing, an upper shielding shell covered downward on the insulating housing, and a lower shielding shell covered upward under the insulating housing. The upper shielding shell has a top plate and a pair of side plates of which one is die-cut to form a positioning slice restricted between the stop blocks of the corresponding side wall. A front of each side plate is punched outward to form a vertical arched restricting portion. The lower shielding shell has a bottom plate and a pair of lateral plates of which a front of each top edge is concaved downward to form a restricting gap buckling the corresponding restricting portion therein.

6 Claims, 3 Drawing Sheets

CARD CONNECTOR

BACKGROUND OF THE INVENTION

1. Field of the Invention

The present invention relates to a card connector, and more particularly to a card connector having a shielding shell.

2. The Related Art

A card connector is often used for connecting external electronic cards with electronic products for realizing signal transmission between the electronic cards and the electronic products. At present, the card connector is more and more widely used in people's daily life. The card connector generally includes an insulating housing, a plurality of electrical terminals disposed in the insulating housing, and a shielding shell enclosing the insulating housing. The insulating housing is substantially of rectangular shape and defines a receiving room in a top thereof. Accordingly, a pair of side walls is formed at two opposite sides of the receiving room. Two opposite outsides of the side walls protrude outward to form a plurality of fastening blocks. The shielding shell has a pair of side plates with a plurality of fastening holes opened for buckling the fastening blocks therein. However, it can only make sure the stability of the shielding shell relative to the insulating housing along the up-down direction. In the process of inserting or extracting the electronic card into or out of the card connector, or when the card connector is shocked, the shielding shell is apt to move relative to the insulating housing along the front-to-rear direction. If an excessive movement happens, the shielding shell may fall off from the insulating housing. Therefore, a card connector capable of overcoming the aforesaid problems is required.

SUMMARY OF THE INVENTION

Accordingly, an object of the present invention is to provide a card connector including an insulating housing, a plurality of electrical terminals, an upper shielding shell and a lower shielding shell. The insulating housing has a bottom board, a pair of side walls protruding upward from two opposite sides of the bottom board, and a rear wall protruding upward from a rear end of the bottom board. A receiving room is surrounded among the side walls and the rear wall. An outside of one side wall protrudes outward to form a pair of stop blocks spaced from each other along a front-to-rear direction. The electrical terminals are disposed in the insulating housing and electrically project upward into the receiving room. The upper shielding shell is covered downward on the insulating housing, and has a top plate and a pair of side plates extending downward from two opposite side edges of the top plate. A substantial middle of one side plate is die-cut to form a positioning slice restricted between the stop blocks of the side wall. A front of each side plate is punched outward to form a vertical arched restricting portion. The lower shielding shell is covered upward under the insulating housing, and has a bottom plate and a pair of lateral plates extending upward from two opposite side edges of the bottom plate. A front of a top edge of each lateral plate is concaved downward to form a restricting gap buckling the corresponding restricting portion of the upper shielding shell therein.

As described above, the card connector of the present invention utilizes the positioning slice restricted between the stop blocks to avoid the movement of the upper shielding shell relative to the insulating housing along the front-to-rear direction. The card connector further utilizes the restricting gap buckling the corresponding restricting portion therein to avoid the movement of the lower shielding shell relative to the upper shielding shell along the front-to-rear direction. So, the card connector can effectively make sure the stability of the shielding shells relative to the insulating housing along the front-to-rear direction.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
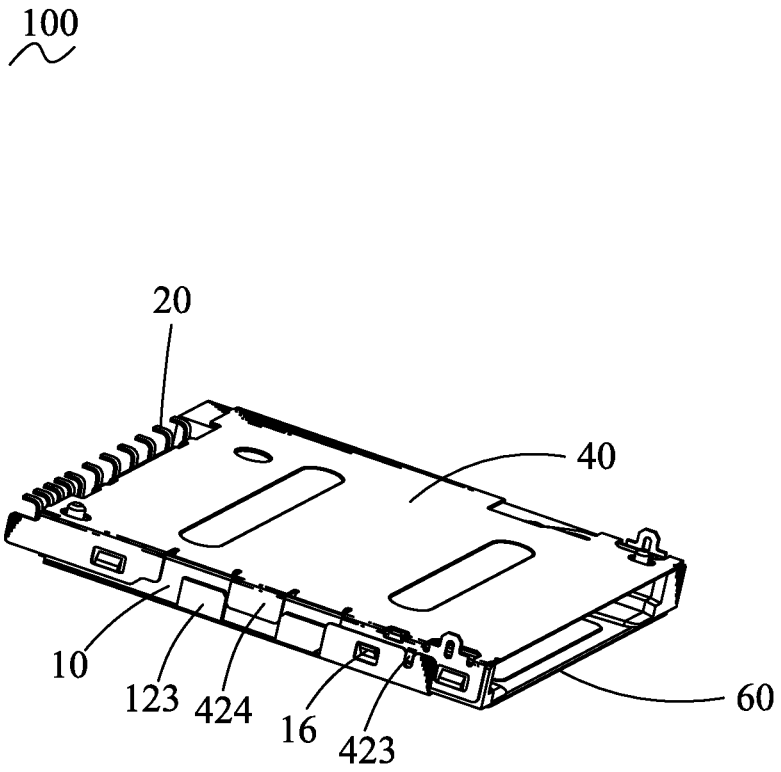
FIG. 1 is an assembled perspective view of a card connector according to an embodiment of the present invention.
Figure 2:
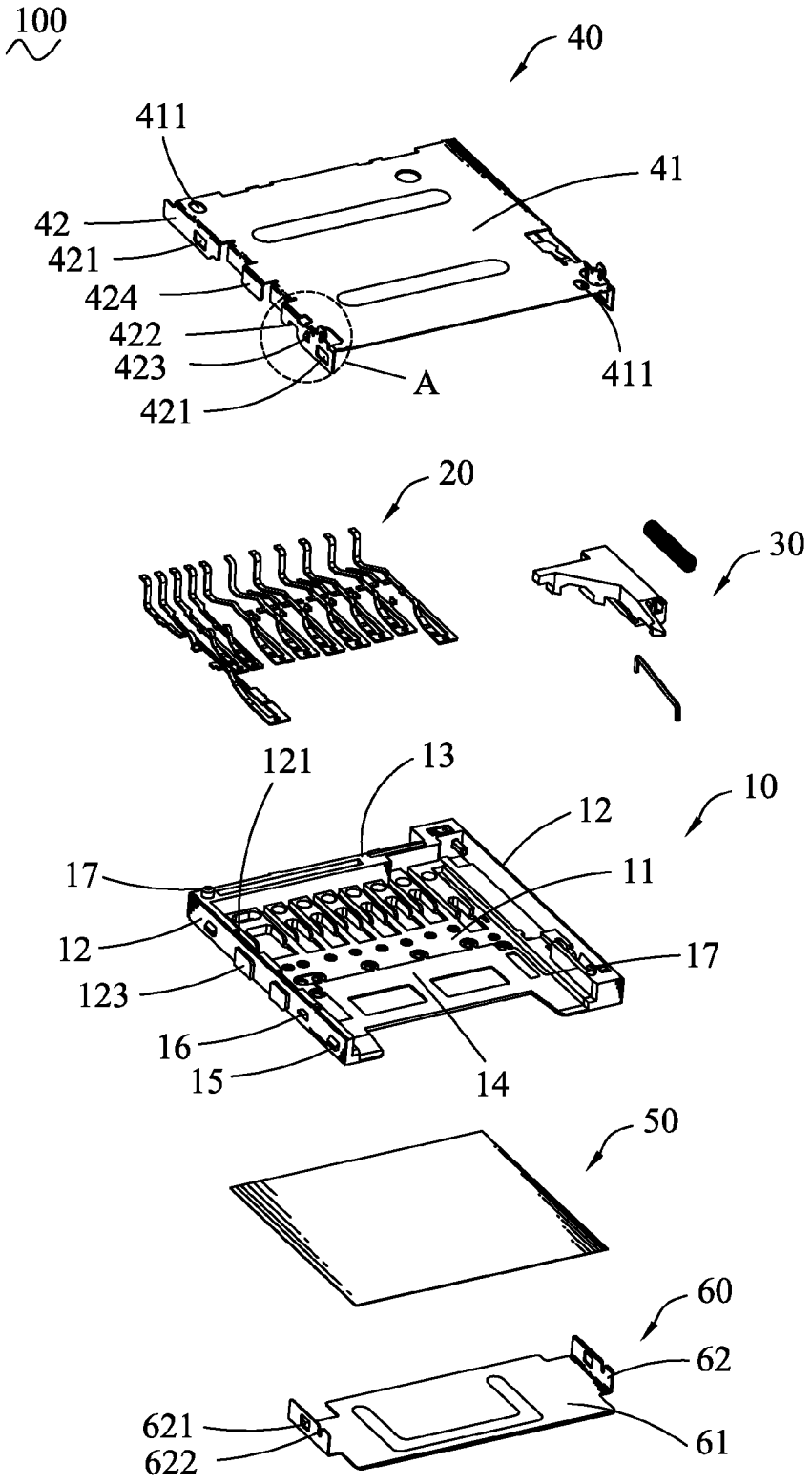
FIG. 2 is an exploded perspective view of the card connector of FIG. 1.
Figure 3:
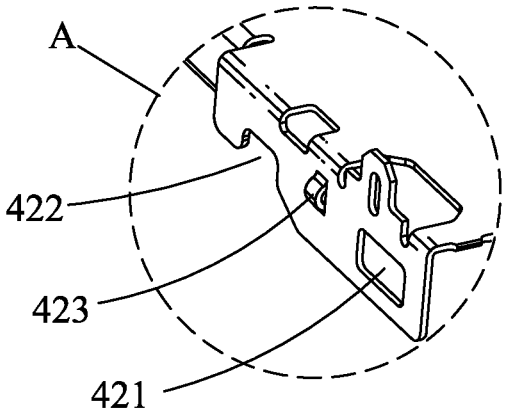
FIG. 3 is a partly enlarged view of an encircled part A of an upper shielding shell of the card connector of FIG. 2.
Figure 4:
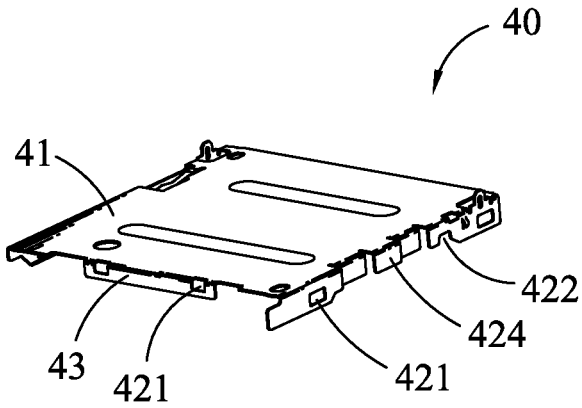
FIG. 4 is another angle of perspective view of the upper shielding shell of the card connector of FIG. 2.

With reference to FIG. 1 and FIG. 2, a card connector 100 according to an embodiment of the present invention includes an insulating housing 10, a plurality of electrical terminals 20, an upper shielding shell 40 and a lower shielding shell 60.

The insulating housing 10 has a bottom board 11, a pair of side walls 12 protruding upward from two opposite sides of the bottom board 11, and a rear wall 13 protruding upward from a rear end of the bottom board 11. A receiving room 14 is surrounded among the side walls 12 and the rear wall 13. An outside of one side wall 12 protrudes outward to form a pair of stop blocks 123 spaced from each other along a front-to-rear direction. The electrical terminals 20 are disposed in the insulating housing 10 and electrically project upward into the receiving room 14. The upper shielding shell 40 is covered downward on the insulating housing 10, and has a top plate 41 and a pair of side plates 42 extending downward from two opposite side edges of the top plate 41. A substantial middle of one side plate 42 is die-cut to form a positioning slice 424 restricted between the stop blocks 123 of the side wall 12. A front of each side plate 42 is punched outward to form a vertical arched restricting portion 423. The lower shielding shell 60 is covered upward under the insulating housing 10, and has a bottom plate 61 and a pair of lateral plates 62 extending upward from two opposite side edges of the bottom plate 61. A front of a top edge of each lateral plate 62 is concaved downward to form a restricting gap 622 buckling the corresponding restricting portion 423 of the upper shielding shell 40 therein.

Referring to FIGS. 1 and 2 again, a top of one side wall 12 of the insulating housing 10 is concaved downward to form two inserting slots 121. Two parts of one side plate 42 of the upper shielding shell 40 adjacent to two sides edges of the positioning slice 424 are die-cut to further form two positioning slices 424 inserted downward in the inserting slots 121 respectively. A top of the rear wall 13 near to one side wall 12 and a top of a front of the other side wall 12 protrude upward to form two positioning pillars 17. Two corners of the top plate 41 of the upper shielding shell 40 define a pair of positioning holes 411 for locating the positioning pillars 17 respectively.

Referring to FIGS. 1-4, two opposite outsides of the side walls 12 and a rear side of the rear wall 13 of the insulating housing 10 protrude outward to form a plurality of fastening blocks 15 of which each top face is slantwise downward. A rear edge of the top plate 41 of the upper shielding shell 40 extends downward to form a rear plate 43. The side plates 42 and the rear plate 43 define a plurality of fastening holes 421 for buckling the corresponding fastening blocks 15 therein. The two opposite outsides of the side walls 12 further protrude outward to form a pair of buckling blocks 16 of which each bottom face is slantwise upward. Bottom edges of the side plates 42 are concaved upward to form two receiving gaps 422 for locating the corresponding buckling blocks 16 therein. The lateral plates 62 of the lower shielding shell 60 abut against two opposite outsides of the side plates 42 of the upper shielding shell 40 and define a pair of buckling holes 621 for buckling the corresponding buckling blocks 16 therein.

Referring to FIG. 2 again, the card connector 100 further includes an ejection device 30 and an insulating tape 50 of rectangular slice shape. The ejection device 30 is movably disposed in the other side wall 12 of the insulating housing 10 and further projects sideward into the receiving room 14. The insulating tape 50 is attached on a bottom surface of the bottom board 11 of the insulating housing 10 to close over bare parts of the electrical terminals 20 in the bottom board 11.

As described above, the card connector 100 of the present invention utilizes the positioning slice 424 restricted between the stop blocks 123 to avoid the movement of the upper shielding shell 40 relative to the insulating housing 10 along the front-to-rear direction. The card connector 100 further utilizes the restricting gap 622 buckling the corresponding restricting portion 423 therein to avoid the movement of the lower shielding shell 60 relative to the upper shielding shell 40 along the front-to-rear direction. So, the card connector 100 can effectively make sure the stability of the shielding shells 40, 60 relative to the insulating housing 10 along the front-to-rear direction.

What is claimed is:

1. A card connector, comprising:

an insulating housing having a bottom board, a pair of side walls protruding upward from two opposite sides of the bottom board, and a rear wall protruding upward from a rear end of the bottom board, a receiving room being surrounded among the side walls and the rear wall, an outside of one side wall protruding outward to form a pair of stop blocks spaced from each other along a front-to-rear direction;

a plurality of electrical terminals disposed in the insulating housing and electrically projecting upward into the receiving room;

an upper shielding shell covered downward on the insulating housing, the upper shielding shell having a top plate and a pair of side plates extending downward from two opposite side edges of the top plate, a substantial middle of one side plate being die-cut to form a positioning slice restricted between the stop blocks of the side wall, a front of each side plate being punched outward to form a vertical arched restricting portion; and a lower shielding shell covered upward under the insulating housing, the lower shielding shell having a bottom plate and a pair of lateral plates extending upward from two opposite side edges of the bottom plate, a front of a top edge of each lateral plate being concaved downward to form a restricting gap buckling the corresponding restricting portion of the upper shielding shell therein.

2. The card connector as claimed in claim 1, wherein a top of one side wall of the insulating housing is concaved downward to form two inserting slots, two parts of one side plate of the upper shielding shell adjacent to two sides edges of the positioning slice are die-cut to further form two positioning slices inserted downward in the inserting slots respectively.

3. The card connector as claimed in claim 1, wherein two opposite outsides of the side walls and a rear side of the rear wall of the insulating housing protrude outward to form a plurality of fastening blocks of which each top face is slantwise downward, a rear edge of the top plate of the upper shielding shell extends downward to form a rear plate, the side plates and the rear plate define a plurality of fastening holes for buckling the corresponding fastening blocks therein.

4. The card connector as claimed in claim 3, wherein the two opposite outsides of the side walls further protrude outward to form a pair of buckling blocks of which each bottom face is slantwise upward, bottom edges of the side plates are concaved upward to form two receiving gaps for locating the corresponding buckling blocks therein, the lateral plates of the lower shielding shell abut against two opposite outsides of the side plates of the upper shielding shell and define a pair of buckling holes for buckling the corresponding buckling blocks therein.

5. The card connector as claimed in claim 1, wherein a top of the rear wall near to one side wall and a top of a front of the other side wall protrude upward to form two positioning pillars, two corners of the top plate of the upper shielding shell define a pair of positioning holes for locating the positioning pillars respectively.

6. The card connector as claimed in claim 1, further comprising an insulating tape of rectangular slice shape which is attached on a bottom surface of the bottom board of the insulating housing to close over bare parts of the electrical terminals in the bottom board.

* * * * *